US010059408B2

(12) United States Patent
Malburet et al.

(10) Patent No.: US 10,059,408 B2
(45) Date of Patent: Aug. 28, 2018

(54) DEVICE FOR HANDLING AND TOWING A SUBMERSIBLE OBJECT

(71) Applicant: THALES, Courbevoie (FR)

(72) Inventors: Rémy Malburet, Plouzane (FR); Yohann Fraisse, Brest (FR); Jean Lagadec, Gouesnou (FR); Benoît Theckes, Saint Renan (FR); Philippe Vicariot, Le Relecq Kerhuon (FR)

(73) Assignee: THALES, Courbevoie (FR)

( * ) Notice: Subject to any disclaimer, the term of this patent is extended or adjusted under 35 U.S.C. 154(b) by 0 days.

(21) Appl. No.: 15/537,358

(22) PCT Filed: Feb. 26, 2016

(86) PCT No.: PCT/EP2016/054176
§ 371 (c)(1),
(2) Date: Jun. 16, 2017

(87) PCT Pub. No.: WO2016/135337
PCT Pub. Date: Sep. 1, 2016

(65) Prior Publication Data

US 2018/0001969 A1 Jan. 4, 2018

(30) Foreign Application Priority Data

Feb. 27, 2015 (FR) ..... 15 00387

(51) Int. Cl.
*B63B 27/00* (2006.01)
*B63B 21/66* (2006.01)
*B63G 8/42* (2006.01)

(52) U.S. Cl.
CPC ..... *B63B 21/66* (2013.01); *B63B 27/00* (2013.01); *B63G 8/42* (2013.01); *B63B 2708/00* (2013.01)

(58) Field of Classification Search
CPC ..... B66C 23/52; B66C 13/02; B63B 21/66; B63B 27/36
(Continued)

(56) References Cited

U.S. PATENT DOCUMENTS 2,780,196 A * 2/1957 Jareckie ..... B66C 13/02 114/210
3,494,443 A * 2/1970 Huffhines ..... G01V 1/38 114/254
(Continued)

FOREIGN PATENT DOCUMENTS

CA 1 120 790 A 3/1982
FR 1 470 355 A 2/1967
(Continued)

*Primary Examiner* — Samuel J Morano, IV
*Assistant Examiner* — Jovon E Hayes
(74) *Attorney, Agent, or Firm* — Baker & Hostetler LLP

(57) ABSTRACT

A device for handling and towing a submersible object includes a tilting structure with a support, to pivot about a first axis parallel to a horizontal plane, and equipped with a guide device, a pivot connection about a second axis in a plane substantially perpendicular to the first axis, to allow a rotary part of the tilting structure to rotate relative to the support, the rotary part having the guide device, a stabilizing device to keep the rotary part in a deployed position relative to the support provided a torque of the relative pivoting between the rotary part and support about the second axis does not exceed a predetermined threshold, to allow the rotary part, equipped with the guide device, to rotate relative to the support about the second axis once a torque of relative pivoting between the rotary part and support about the second exceeds the threshold.

18 Claims, 6 Drawing Sheets

(58) Field of Classification Search
USPC ..... 114/242, 244
See application file for complete search history.

(56) References Cited

U.S. PATENT DOCUMENTS

| | | | | | |
|---|---|---|---|---|---|
| 3,966,171 | A * | 6/1976 | Hale | B63B 27/36 | 114/244 |
| 4,317,524 | A * | 3/1982 | Andersson | B63B 27/10 | 212/261 |
| 4,597,352 | A * | 7/1986 | Norminton | B63G 8/42 | 114/254 |
| 4,754,442 | A * | 6/1988 | Baker | B63G 8/42 | 114/254 |
| 5,143,479 | A * | 9/1992 | Whidden, Jr. | E02B 15/08 | 254/280 |
| 8,430,049 | B1 * | 4/2013 | Tureaud | B63G 8/42 | 114/258 |

FOREIGN PATENT DOCUMENTS

| | | |
|---|---|---|
| FR | 2 212 808 A5 | 7/1974 |
| FR | 2 644 445 A1 | 9/1990 |

* cited by examiner

DEVICE FOR HANDLING AND TOWING A SUBMERSIBLE OBJECT

CROSS-REFERENCE TO RELATED APPLICATIONS

This application is a National Stage of International patent application PCT/EP2016/054176, filed on Feb. 26, 2016, which claims priority to foreign French patent application No. FR 1500387, filed on Feb. 27, 2015, the disclosures of which are incorporated by reference in their entirety.

FIELD OF THE INVENTION

The present invention relates to a device for handling and towing a volumetric submersible object such as a sonar. It allows a submersible object to be launched and recovered from a ship and allows this submersible object to be towed by the ship by means of a streamlined cable. The submersible object is anchored to the cable.

BACKGROUND

Handling and towing devices are fixed to the deck of a ship. Conventionally they comprise a structure equipped with a guide device, such as a pulley, allowing the guiding of the cable and a winch allowing the cable to be hauled in and paid out. The structure is able to tilt about an axis of tilting so that the launching and recovery of the submersible object are performed by tilting the structure between an operational or towing position in which the guide device is situated in a high position and a position for launching and recovering the underwater vehicle, in which position the guide device is situated in a low position relative to the deck of the ship. Conventionally, handling devices are installed at the rear of the boat so that the guide device is situated to the rear of the tilting structure along the axis of the ship and the axis of tilting is substantially horizontal and perpendicular to the longitudinal axis of the ship.

During the phase of towing of the submersible object, the structure is rigid, which means to say that it is engineered not to deform, namely to withstand the effect of the forces associated with the sea. There are two major events that govern the specifying of the handling and towing device. A first type of event is the arrival of a high wave when the structure is in the position for launching and recovering the underwater vehicle, which applies a very high lateral force to the structure. What is meant by a lateral force is a force that has a component parallel to the axis of tilting of the structure.

A second type of event is the submersible object or the cable catching on an underwater obstacle, for example on a submarine or on the sea bed on a rock. This second type of event may bring the object along the side of the boat if the point of catching is offset laterally with respect to the axis of the ship or the axis of rotation of the structure and apply very high lateral forces to the structure as the ship moves forward.

These two types of event are exceptional but lead to lateral forces on the structure which are of the order of twice the nominal force that the structure needs to be capable of absorbing without deforming. The structure and, more generally, the handling and towing device, is therefore reinforced to withstand these exceptional forces, at the expense of the mass of the device overall.

SUMMARY OF THE INVENTION

It is an object of the present invention to provide a handling and towing device of lower mass.

To this end, one subject of the invention is a device for handling and towing a submersible object intended to be installed on a ship, the device comprising:

a support intended to be fixed to the deck of the ship, the support comprising at least one support element comprising a plane surface forming a plane intended to extend parallel to the surface of the water in a calm sea state, a towing cable for towing the submersible object, a winch allowing the cable to be hauled in and paid out, a tilting structure supported by said support and able to pivot with respect to the support about a first axis parallel to said plane, said tilting structure being equipped with a first guide device allowing the cable to be guided, a pivot connection about a second axis situated in a plane substantially perpendicular to the first axis of rotation, arranged so as to allow a rotary part of the tilting structure to rotate with respect to the support, said rotary part being equipped with the first guide device, a stabilizing device able to be in an operational configuration in which it is configured to keep the rotary part of the tilting structure in a deployed position with respect to the support as long as a torque of the relative pivoting between the rotary part and the support about the second axis is below or equal to a predetermined threshold, and so as to allow the rotary part, equipped with the first guide device, to rotate with respect to the support about the second axis once a torque of relative pivoting between the rotary part and the support about the second exceeds said threshold.

The device according to the invention advantageously has at least one of the following features considered alone or in combination:

the threshold is above or equal to 50 kN*m, the first guide device allows the cable to be guided between the cable end that is intended to be immersed and the winch, and is arranged to prevent the cable from forming an angle smaller than a first angle in a plane perpendicular to the first axis and to limit the lateral deflection of the cable along an axis parallel to the first axis, the handling device being arranged in such a way that when the stabilizing device allows the relative rotation between the rotary part and the support about the second axis, the rotary part is able to move into a folded position, relative to the support, in which position the length of the tilting structure between the first axis of rotation and the first guide device, projected on an axis running parallel to the support plane and perpendicular to the first axis of rotation is of lesser magnitude than when the rotary part and the support are in the deployed relative position, the rotary part of the tilting structure is the tilting structure, the tilting structure comprises a fixed part secured to the support in terms of rotation about the second axis and the rotary part connected to the support via the part fixed to the support, the fixed part being connected to the rotary part via the pivot connection about the second axis, the fixed part supports the rotary part, the rotary part extends longitudinally in the continuation of the fixed part along an axis secured to the fixed part perpendicular to the first axis and forming the longitudinal axis of the fixed part, the fixed part has the overall shape of a jib the base of which is fixed to the support by means of the pivot connection about the first axis and pointing in a direction perpendicular to the first axis, the rotary part extending longitudinally in the continuation of the jib in the direction in which the jib points when the structure is deployed, the stabilizing device is reversible or irreversible, the stabilizing device is disengageable, the stabilizing device comprises locking means allowing the position of the rotary part with respect to the support to be locked when the rotary part is in a folded position with respect to the support, the stabilizing device is configured to damp the relative rotational movement between the rotary part and the support about the second axis of rotation, the stabilizing device is configured in such a way as to return the rotary part to the deployed position with respect to the support and to keep it in this position when, once the stabilizing device allows the rotary part to rotate with respect to the support about the second axis, the pivoting torque exerted on the rotary part about the axis is below a second threshold torque lower than the first threshold torque, the device comprises a second guide device allowing the cable to be guided through which the cable passes between the first guide device and the winch, the second guide device comprising at least one deflector making it possible to prevent the radius of curvature of the cable dropping below a predetermined threshold in a plane substantially perpendicular to the second axis when the rotary part pivots about the second axis with respect to the support, the second axis of rotation is substantially perpendicular to the plane comprising an axis parallel to the axis and a longitudinal axis along which the structure extends longitudinally when it is in the deployed position with respect to the support, —the tilting part is configured in such a way that when the torque of relative pivoting exceeds the threshold, the rotary part is driven, by the cable, in rotation about the second axis with respect to the support, the winch is fixed in terms of rotation with respect to the support about the axis x2.

The invention also relates to a handling assembly comprising a ship on board which is carried a handling and towing device according to the invention, said support being fixed to the ship in such a way that plane surface forming the plane extends substantially parallel to the surface of the water in a calm sea state.

Another subject of the invention is a handling and towing device, said support being fixed to the ship in such a way that plane surface forming the plane extends substantially parallel to the surface of the water in a calm sea state.

Thus, when the load on the cable towing the submersible body becomes a lateral load and exceeds a predetermined threshold, the rotary part of the structure articulates about a second axis with respect to the support, making it possible to reduce the mechanical forces to which the handling device is subjected and allowing the creation of a structure and/or a support that is more lightweight.

Another advantage is that of reducing the lateral forces on the deck of the ship at the fixing of the handling and towing device to the ship, making it possible to reduce the mass of the support, of the means of fixing the device to the deck and of the structure of the deck.

BRIEF DESCRIPTION OF THE DRAWINGS

Further features and advantages of the invention will become apparent from reading the detailed description which follows, given by way of nonlimiting example and with reference to the attached drawings in which.

From one figure to another, the same elements are identified by the same references.

DETAILED DESCRIPTION

Figure 1:
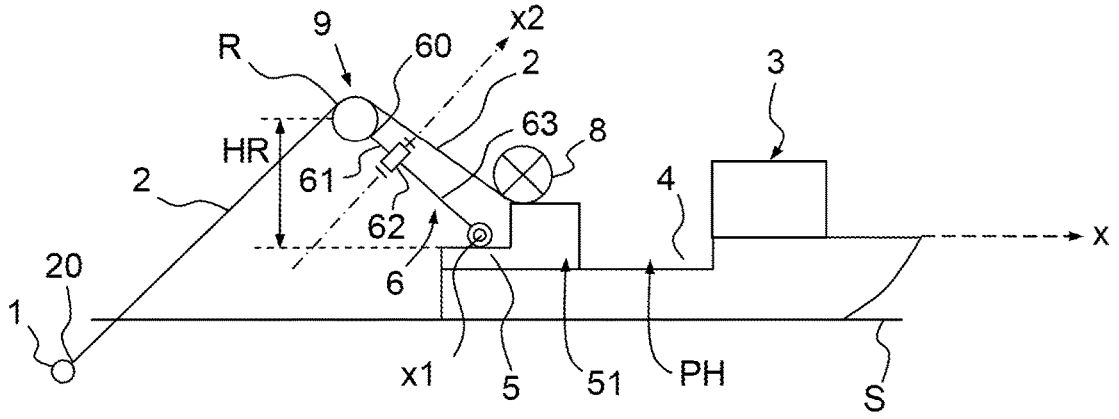
FIG. 1 schematically depicts a ship on board which is installed a device according to the invention towing a submersible body, the structure of the device according to the invention being in the towing position and being deployed with respect to the support, FIG. 2 schematically depicts a ship on board which is installed a device according to the invention towing a submersible body, the structure of the device according to the invention being in the position for launching and recovering the submersible object and being deployed with respect to the support.

FIG. 1 schematically depicts a ship 3 equipped with a handling and towing device according to the invention. This handling device allows a submersible object 1 to be launched and recovered and allows this object to be towed by means of a cable 2 forming part of the device when said object is being towed by the ship 3. The submersible object 1 is, for example, a volumetric sonar enclosed in a volumetric housing. It is anchored to the cable 2.

The handling device comprises a support 5 fixed to the deck 4 of the ship 3.

Figure 2:
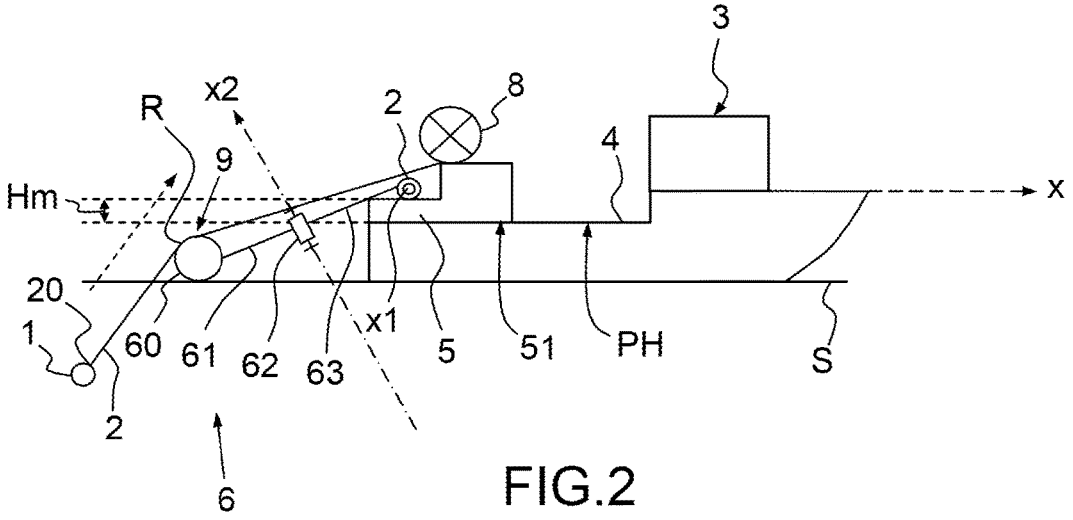

The handling device comprises the cable 2 and a winch 8 allowing the cable 2 to be hauled in and paid out. The winch 8 comprises a winch structure (or chassis) that is fixed with respect to the support and a drum mobile in rotation with respect to the structure of the winch. It also comprises a tilting structure 6 equipped with a first device for guiding the cable 9 and supported by the support 5. The tilting structure 6 is mounted on the support 5 so as to be able to pivot with respect to the support 5 about a first axis x1 perpendicular to the plane of the page. The structure is tiltable so that launching and recovering the submersible object are performed by tilting the tilting structure 6 with respect to the support 5 between a towing position depicted in FIG. 1, in which the first cable guide device 9 is situated in a high position with respect to the support and a position for launching and recovering the underwater vehicle, depicted in FIG. 2, in which position the first guide device 9 is in a low position with respect to the support. As a result, in the towing position, the first guide device 9 is situated at a height HR (in this instance positive) with respect to the support at the height greater than the height Hm (in this instance negative) at which it is situated with respect to the support 5 in the launch and recovery position. The heights are measured along an axis perpendicular to a plane 51 which will be defined later on. FIG. 2 depicts the modules of the heights. The winch 8 may be fixed or secured in terms of rotation about the first axis x1 with respect to the tilting structure or with respect to the support 5. The fixing of the winch 8 to the support 5, about the axis x1, makes it possible to limit the size of the tilting structure.

As an alternative, the tilting structure is mounted in such a way as to be able to be given a circular translational movement with respect to the support. In other words, each part pi of the tilting structure is able to pivot about a first axis x1*i*. The distances between the various parts pi and the respective first axes of rotation x1*i* are the same which means that they are given circular paths with the same radius. As a result, the tilting structure is mounted in such a way as to be able to pivot about a single axis x1, the connection between the support and the tilting structure then being a pivot connection, or about several mutually parallel axes x1*i*.

The first guide device 9 is configured and arranged in such a way as to guide the cable. Advantageously, the first guide device is configured to support the cable 2 and alter the direction of the cable between upstream and downstream of the first guide device 9, namely between the cable part that is being towed and the winch. Advantageously, the first guide device is arranged in such a way as to alter the direction of the cable in a plane P perpendicular to the axis x1 when the structure 6 is deployed. This plane P is the plane of the page in FIGS. 1 and 2. What is meant by a deployed structure will be explained later on. The first guide device 9 is advantageously arranged to prevent the cable 2 from forming an angle smaller than a first predetermined angle in the plane P. It is also advantageously configured to limit the lateral deflection of the cable 2 along an axis parallel to the first axis x1 when the structure 6 is deployed. The first guide device 9 is advantageously arranged to limit the lateral deflection of the cable along an axis perpendicular to the second axis x2.

The first guide device 9 comprises the towing point R of the cable 2. What is meant by the towing point R is the position of the point at which the cable 2 bears on the device handling the cable 2, which is closest to that end 20 of the cable 2 that is intended to be immersed, namely closest to the towed object. The cable part that is towed is the part of the cable comprised between the towing point R and the submerged end of the cable. In a towing situation, the end 20 is submerged with the towed body 1 and the cable 2 rises as far as the first guide device 2 where it changes direction and extends longitudinally along the tilting structure 6 as far as the winch 8. In other words, the cable 2 passes through the first guide device 9 and then along the tilting structure to reach the winch 8.

Figure 3:
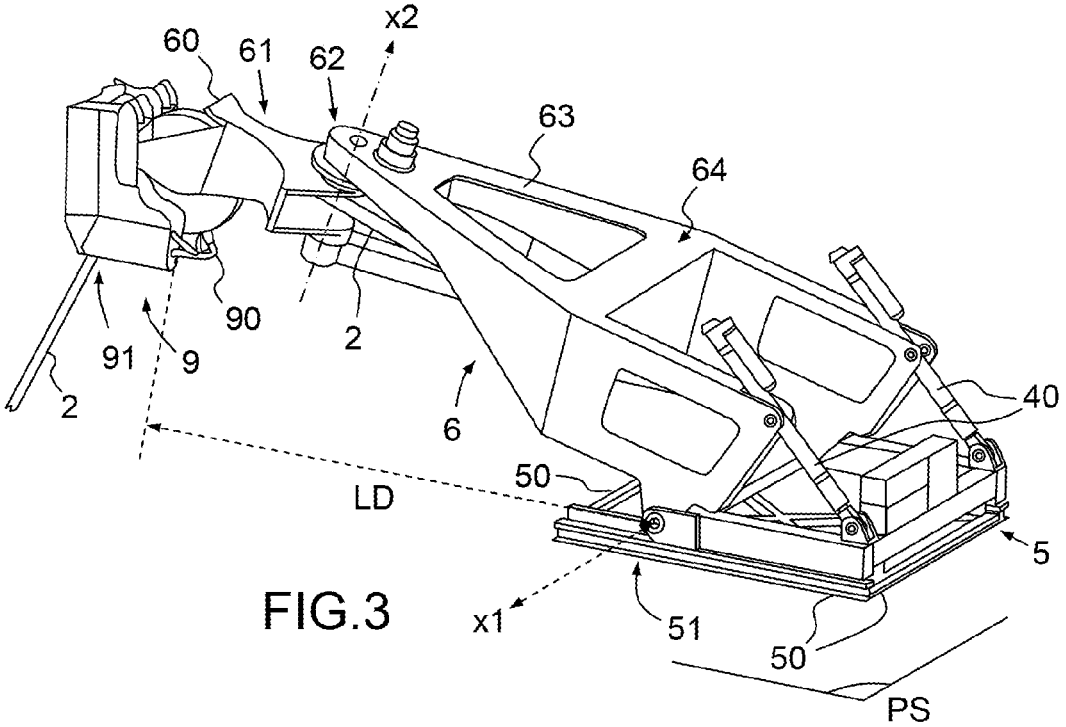
FIG. 3 illustrates, in a perspective view, one preferred embodiment of the device according to the invention when the structure is deployed and in the towing position.
Figure 5:
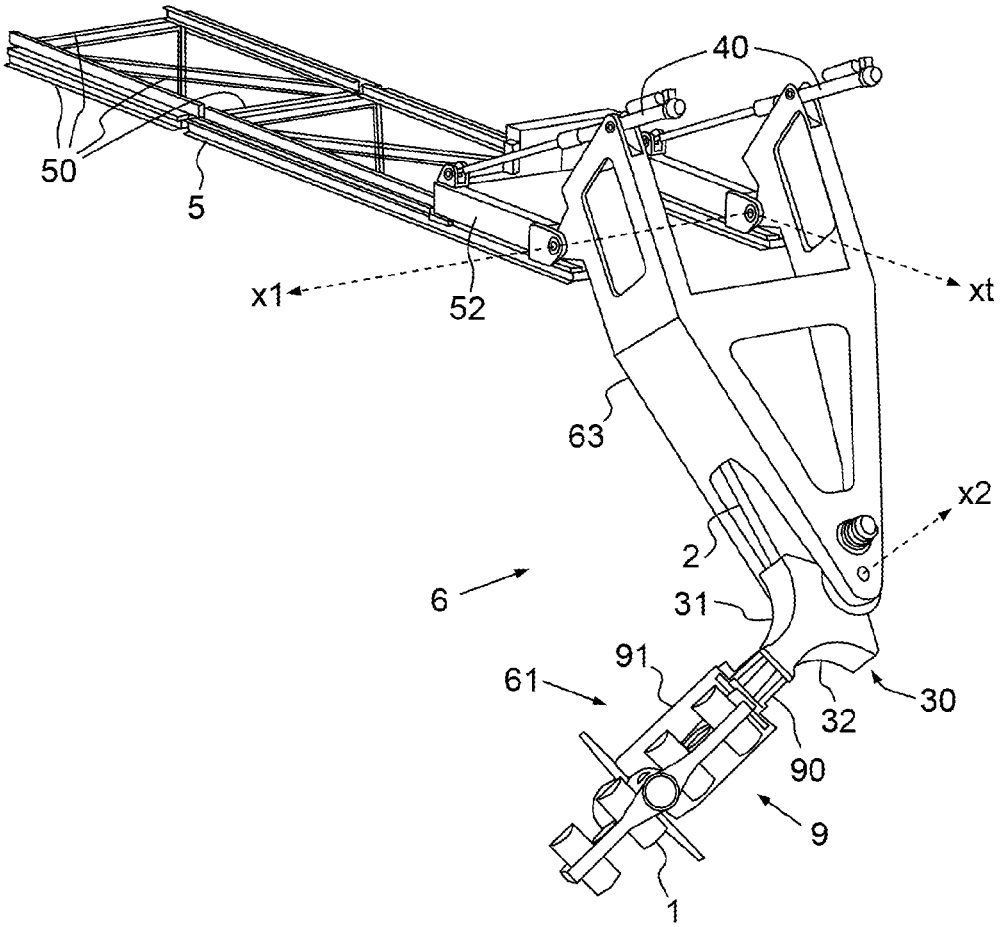
FIG. 5 illustrates the embodiment of FIG. 2 in perspective when the structure is folded and in a position for launching and recovering the submersible object.
Figure 4:
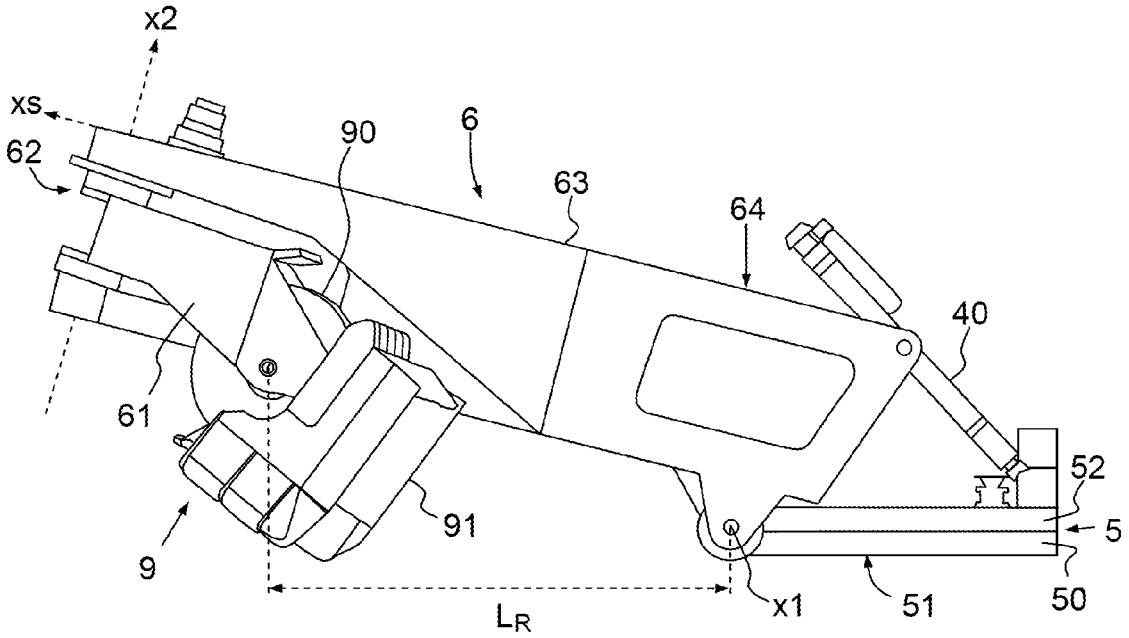
FIG. 4 illustrates the embodiment of FIG. 3 in side view when the structure is folded and in the towing position; for greater clarity, the cable is not depicted in FIG. 4.

A detailed example of a handling device according to the invention is depicted in FIGS. 3 to 5. The device comprises drive means 40 allowing the structure 6 to be made to pivot about the axis x1. For greater clarity, the winch 8 is not depicted in these figures. In FIG. 3, the structure is in a towing position with respect to the support and is deployed. The first guide device comprises a pulley 90. This pulley is a turn pulley. It allows the cable to be guided between the cable end intended to be immersed and the winch. This pulley 90 has an axis of rotation substantially parallel to the axis x1 when the structure 6 is deployed. It makes it possible to alter the direction of the cable in the plane P and to limit the lateral deflection of the cable along an axis parallel to the axis x1. As an alternative, the first guide device 9 comprises a deflector arranged and configured to prevent the cable from forming an angle smaller than a first angle in the plane P and comprising end stops making it possible to limit the lateral deflection of the cable when the structure 6 is deployed.

Conventionally, as depicted in FIGS. 1 and 2, the towing device is installed at the rear of the ship 3, on the deck 4 of the ship 3. It is conventionally installed on the ship 3 in such a way that the first axis x1 is substantially parallel to a horizontal plane PH which is a plane P of the ship intended to be parallel with the surface of the water in a calm sea state. The support 5 comprises at least one support element comprising a plane surface 51 extending in a support plane PS, said plane surface 51 being intended to be placed on the ship and to extend parallel to the plane PH of the ship 1. In the example depicted in FIGS. 3 to 5, the support 5 comprises a plurality of support elements 50, each having a plane surface 51 extending in the support plane. In other words, all of the plane surfaces 51 together define a support plane. As an alternative, the support 5 comprises a single support element having a plane surface fixed to the support plane. The first axis x1 is parallel to the support plane. In the embodiment of FIGS. 3 to 5, the structure 6 is mounted with translational mobility with respect to the support 5 along an axis perpendicular to the axis x1. It is mounted on an intermediate support 52 mounted with translational mobility only with respect to the support 5. The structure is mounted with rotational mobility about the axis x1 with respect to the intermediate support 52.

The handling device is conventionally installed, as it is in the example of FIG. 1, in such a way that the first axis x1 is perpendicular to the longitudinal axis x of the ship extending from the front to the rear of the ship 3. In this way, when the device is installed on the deck of the ship and the structure is in the launch and recovery position, it is possible to "set down" the submersible body on the surface of the water or to drop it from a small height depending on the distance of the tilting structure with respect to the rear of the boat, depending on the length of the tilting structure and depending on the angle of inclination of the tilting structure with respect to the support in the launch and/or recovery position, for a given position of the first guide device on the tilting structure.

As an alternative, the device is arranged on the ship in such a way that the first axis x1 forms a non-zero angle with the axis x in a plane parallel to the plane PH, for example an angle of 90°, with the first axis x1 in a plane parallel to the plane PH.

In the example depicted in FIGS. 1 and 2, the first guide device 9 is mounted at one end 60 of the tilting structure 6. Because the first axis x1 is perpendicular to the longitudinal axis x of the ship 3, the end in question is the rear end of the tilting structure when the structure is deployed.

The handling device according to the invention comprises a pivot connection 62 about a second axis x2 depicted in FIGS. 1 to 6. The second axis x2 extends in a plane perpendicular or substantially perpendicular to the first axis of rotation x1. This pivot connection 62 is arranged to allow a rotary part 61 of the tilting structure 6 to rotate with respect to the support 5.

The rotary part 61 is able to pivot between a deployed position, depicted in FIG. 3, and a folded position with respect to the support 5, depicted in FIG. 4. What is meant by a deployed position is a position in which the length LD of the tilting structure 6 between the first axis of rotation and the first guide device 90, projected on an axis (here the longitudinal axis of the ship x) running parallel to the support plane PS (here defined by the surfaces 51) and perpendicular to the first axis of rotation x1 is greater than the same length LR when the structure is in a folded position. That is achieved through the choice of the position of the axis x2. When the rotary part 61 is in the deployed position with respect to the support 5 it is said that the tilting structure 6 is deployed, whether the tilting structure 6 is in the towing position or whether it is in the position for launching and recovering the towed body.

The rotary part 61 of the tilting structure 6 is secured to the first guide device 9 in terms of rotation about the second axis x2. In this way, the rotary part 61 drives the first guide device 9 with it in its rotation about the second axis x2 with respect to the support 5. In other words, the rotary part 61 and the first guide device 9 are unable to pivot relative to one another about the axis x2. The rotary part 61 is rigid so that it does not deform as it rotates about the second axis x2 with respect to the support.

FIG. 5 is a perspective depiction of the tilting structure in a folded launch and recovery position in which the rotary part 61 forms a larger angle than in FIG. 4 with respect to its deployed position, about the second axis x2.

In the nonlimiting example of FIGS. 3 to 5, the tilting structure 6 is split into two parts. The tilting structure 6 comprises a rotary part 61 equipped with the first guide device 9 and a fixed part 63 connected to the support 5 and able to pivot with respect to the support 5 about the first axis x1. The pivot connection 62 about the second axis x2 connects the rotary part 61 and the fixed part 63. The rotary part 61 is connected to the support 5 by means of the fixed part 63. The fixed part 63 is secured to the support 5 in terms of rotation about the second axis x2. In other words, the fixed part 63 is unable to pivot with respect to the support about the second axis. The rotary part 61 and the first guide device 90 are secured to the fixed part 63 in terms of rotation about the first axis x1 with respect to the support 5. In other words, the assembly formed by the fixed part 63, the rotary part 61 and the first guide device 90 is unable to pivot relative to one another about the first axis x1. It is this entire assembly that pivots about the axis x1 with respect to the support when the fixed part 63 pivots with respect to the support 5 about the first axis x1. The rotary part 61 and the fixed part 63 are rigid, which means to say that they do not deform when the rotary part pivots about the second axis x2.

In the embodiment of FIGS. 3 to 5, the rotary part 61 is supported by the fixed part 63 in the towing position. As an alternative, the rotary part 61 is suspended from the fixed part 63 in the towing position. Supporting the rotary part allows larger forces to be transmitted from the rotary part to the rigid part and suspending the rotary part from the fixed part allows for a smaller bulk.

In the embodiment of FIGS. 3 to 5, when the structure is deployed, the rotary part 61 extends longitudinally in the continuation of the fixed part 63 along an axis xs secured to the fixed part 63, depicted in FIG. 4, perpendicular to the first axis x1 and forming the longitudinal axis of the fixed part 63. That makes it possible to obtain the greatest length Ld of deployed tilting structure. In this particular example, the fixed part has the overall shape of a jib, the base of which is fixed to the support by the pivot connection about the first axis x1 and pointing in a direction perpendicular to the axis x1. The rotary part 61 is fixed to the fixed part 63 by the pivot connection arranged at the tip of the jib. The rotary part 61 extends longitudinally in the continuation of the jib in the direction xs in which the jib points when the structure is deployed. The jib shape is advantageous because it allows the fixed part to be left a large range of movement about the axis x2, something which is of particular benefit for stowing the structure as will be seen hereinafter. The form of the structure is nonlimiting, the fixed part could be gantry shaped.

According to the invention, the handling device comprises a stabilizing device arranged or configured to keep the rotary part 61 of the tilting structure 6 in the deployed position with respect to the support 5 as long as a torque of relative pivoting between the rotary part 61 and the support 5 about the second axis x2 is below or equal to a predetermined threshold, and so as to allow the rotary part 61 equipped with the first guide device 9 to rotate with respect to the support 5 about the second axis x2 as soon as a torque of relative pivoting between the rotary part 61 and the support 5 about the second x2 exceeds said threshold. In other words, the stabilizing means prevent relative rotation of the rotary part 61 and of the support 5 as long as a torque at the axis x2 is below or equal to the predetermined threshold value when the rotary part 61 is in the deployed position with respect to the support 5 but allow this rotation only when the torque at the second axis is above this threshold value. The value for the threshold is, for example, of the order of 120% of the nominal forces. The nominal forces are the forces encountered when towing at nominal speed and in a nominal sea state.

Thus, in the event of too great a lateral force being applied to the tilting structure 6, the rotary part 61 pivots with respect to the support and, in the example of FIGS. 3 to 5, with respect to the fixed part 62, thereby limiting the transmission of lateral force from the rotary part to the support 5 and to the deck of the ship. The invention makes it possible to contemplate a tilting structure/support/means of fixing the structure to the support/means of fixing the support to the deck of the ship and ship deck structure assembly that is capable of withstanding lower forces than in the case of a rigid tilting structure, and therefore to lighten at least one of these elements and, more particularly, the elements of the handling device.

Advantageously, the threshold is above or equal to 50 kN*m. This threshold value is significant. This choice of value has the disadvantage of not being able to avoid the cable pressing laterally on the guide device in the event of lateral deflection of the cable. By contrast, it allows the jib to be kept in the deployed configuration even when the cable is applying a significant torque to the jib.

Keeping the rotary part 61 fixed with respect to the support 5 when the torque is below or equal to the threshold makes it possible to guarantee a certain stability of the first guide device and of the towed object, when the latter is being raised back up, as far as the first guide device and therefore a certain safety, robustness and reliability. This device is reliable because there is no need to alter the configuration of the stabilizing device so that it keeps the rotary part in a fixed position with respect to the support before raising or launching a towed object. The rotary part is automatically kept in this fixed position in a nominal sea state and for a nominal speed or a speed lower than the nominal speed. Control over the position of the rotary part with respect to the support 5 also allows the operations of recovering the submersible object to be made easier and makes it possible to prevent the rotary part from striking equipment on board the ship or an operator by rotating about the second axis x2 while the object is being towed. Furthermore, the device according to the invention allows control over the position of the tow point along the cable. The rotational movements of the rotary part 61 at any arbitrary moment in the towing could, during towing, give rise to variations in the length of cable between the winch and the submersible object which could cause the towed body to rise or fall when it should not, and lateral deflections of the cable leading to very abrupt overtension in the cable or a falling of the towed object with breakage or damage consequences on the towed body. These movements would also generate substantial force on the first guide device and would damage the cable.

The threshold is for example equal to 100 kN*m or greater than or equal to 100 kN*m. It is, for example, substantially equal to 150 kN*m. As an alternative, the threshold is above 150 kN*m. It may for example be of the order of 200 kN*m or 300 kN*m.

The threshold chosen is dependent on the target application and notably on the length of the towed cable, on the weight of the object intended to be towed, on the nominal sea state and on the maximum nominal speed at which the object is intended to be towed. The maximum nominal speed is the maximum speed at which the object is intended to be towed under nominal operational conditions. The nominal speed is typically comprised between 8 knots and 15 knots for sonar applications. A knot is equal to 0.514 m/s. The maximum nominal sea state is the sea state in which the device is intended to be used. The maximum nominal sea state is typically a force 3 or 4 sea state in sonar applications. The threshold is advantageously chosen so as to allow the jib to fold only under the effect of a torque higher than a torque liable to be encountered under nominal conditions (nominal speed and nominal sea state) for an object of given mass and a cable of given length. In sonar applications, the objects have masses typically ranging from around one hundred kilos to several metric tonnes. The lengths of towed cable are typically of the order of one hundred or several hundred meters.

For example, for a determined sonar application for which the weight of the object intended to be towed, the length of cable and the maximum nominal sea state are predefined, for which the maximum nominal speed is 15 knots, the threshold is for example chosen to allow the device to fold only when the torque reaches the torque generated under the same conditions at a speed of 21 knots. This is because towing will be performed at this speed only under exceptional conditions, for example to catch up with a convoy or to avoid a torpedo or any other operational mission.

In the embodiment of the figures, the rotary part 61 is mounted with the ability to pivot about the axis x2 with respect to the fixed part 63 and the fixed part 63 is secured to the support in terms of rotation about the axis x2. Therefore the stabilizing device is arranged to keep the rotary part 61 of the tilting structure 6 in the deployed position with respect to the fixed part 63 as long as a torque of relative pivoting between the rotary part 61 and the fixed part about the second axis x2 is below or equal to a predetermined threshold, and so as to allow the rotary part 61 equipped with the first guide device 9 to rotate with respect to the fixed part 63 about the second axis x2 as soon as a torque of relative pivoting between the rotary part 61 and the fixed part 63 about the second x2 exceeds said threshold.

In an alternative form, the rotary part 61 of the tilting structure is the tilting structure 6. The pivot connection connects the tilting structure 6 and support 5. Now, the closer the axis of rotation x2 is to the deck of the ship, namely to the support, the greater the weight saving. Therefore this configuration is more advantageous than the embodiment depicted in the figures in terms of weight saving. By contrast, because it is the entire tilting structure that pivots with respect to the support about the axis x2, this embodiment gives rise to a great deal of lateral bulk (about the second axis x2) on the ship as the tilting structure rotates about the second axis x2, necessitating the provision of sufficient deck space to be able to accommodate the absorbing structure as it rotates. The solution depicted in the figures gives rise to a lower bulk. In this solution, the tilting structure may also adopt the overall shape of a jib having a base connected to the support via the two pivot connections about the two directions x1 and x2 and pointing in a direction perpendicular to the axis x1 in the deployed position.

The winch and more particularly the structure of the winch is advantageously fixed with respect to the support 5 in terms of rotation about the second axis x2. That makes it possible to limit the sizing of the second part. For preference, the structure of the winch is fixed with respect to the support 5. That makes it possible to limit the sizing of the tilting structure.

The stabilizing device is of the active or passive type.

It may comprise at least one mechanical weak link, for example a shear pin, designed to shear and to disconnect the rotary part 61 from the fixed part 63 when the torque of pivoting of the rotary part with respect to the support 5 is above a predetermined threshold. This type of stabilizing device has the disadvantage of not being reversible. It does not allow the rotary part 61 to be kept again with respect to the support in the deployed position.

Advantageously, the stabilizing device is of the reversible type. In other words, it allows the rotary part 61 to be kept again with respect to the support 5 in the deployed relative position when it comes again into the deployed relative position once the rotary part 61 leaves the deployed position, namely has pivoted about the second axis x2 with respect to the support 5. In other words, the stabilizing device is configured, when in the operational configuration, to once again keep the rotary part 61 with respect to the support 5 in the deployed relative position, when it returns to the deployed relative position, once it has left the deployed relative position.

Figure 6:
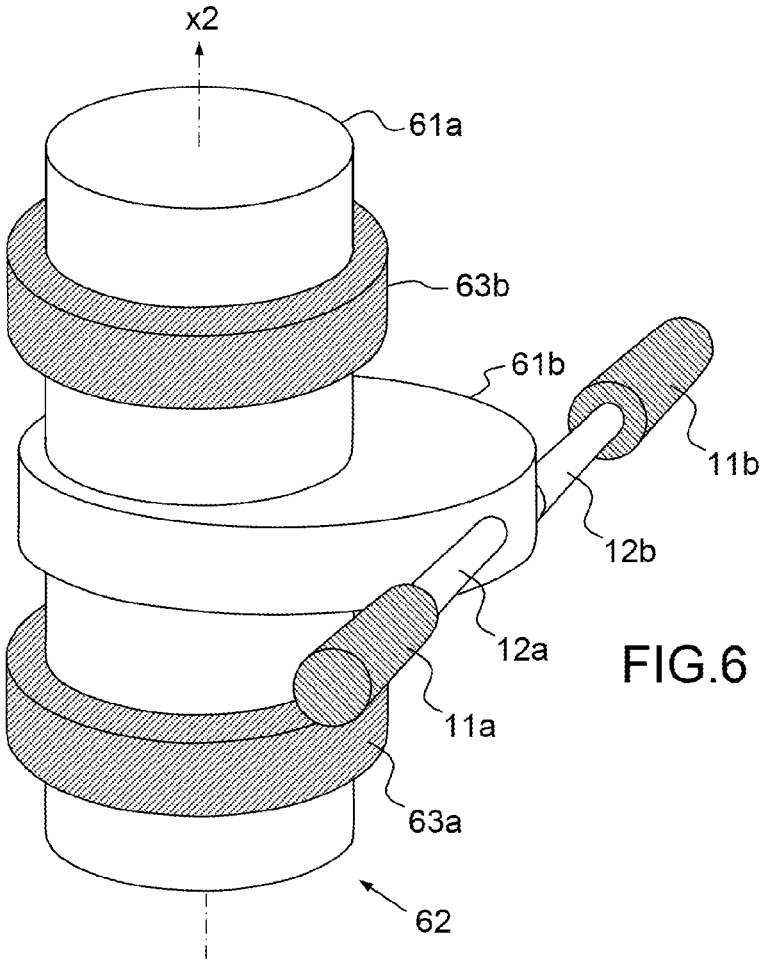
FIG. 6 illustrates an example of a pivot connection about the second axis x2 and an example of a stabilizing device.
Figure 7A:
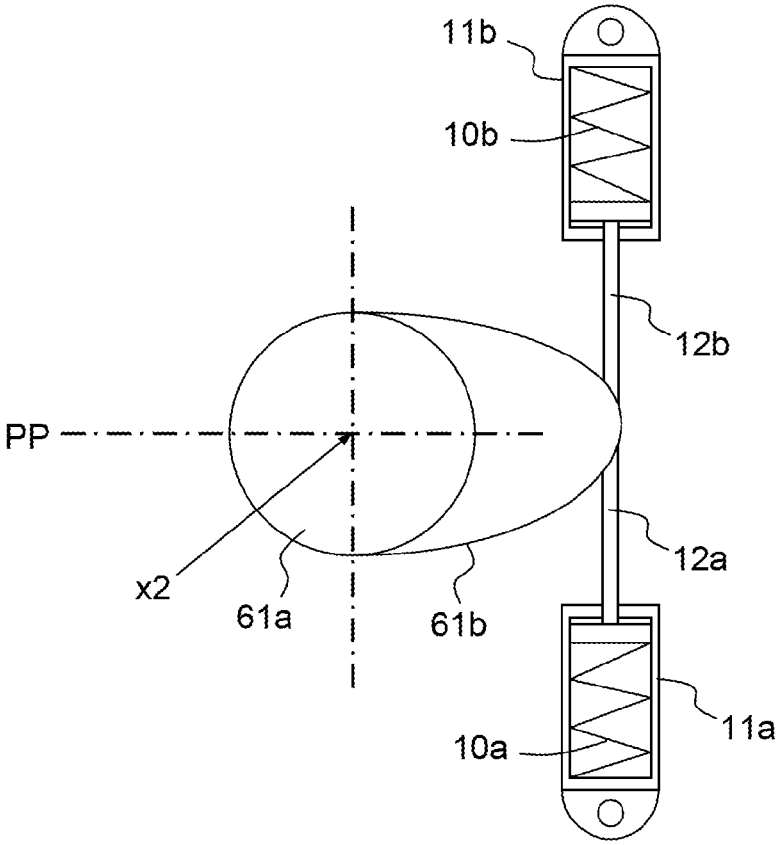
FIGS. 7*a* and 7*b* illustrate the pivot connection and the stabilizing device of FIG. 6 when the structure is in the deployed position (FIG. 7*a*) and folded position (FIG. 7*b*)
Figure 7B:
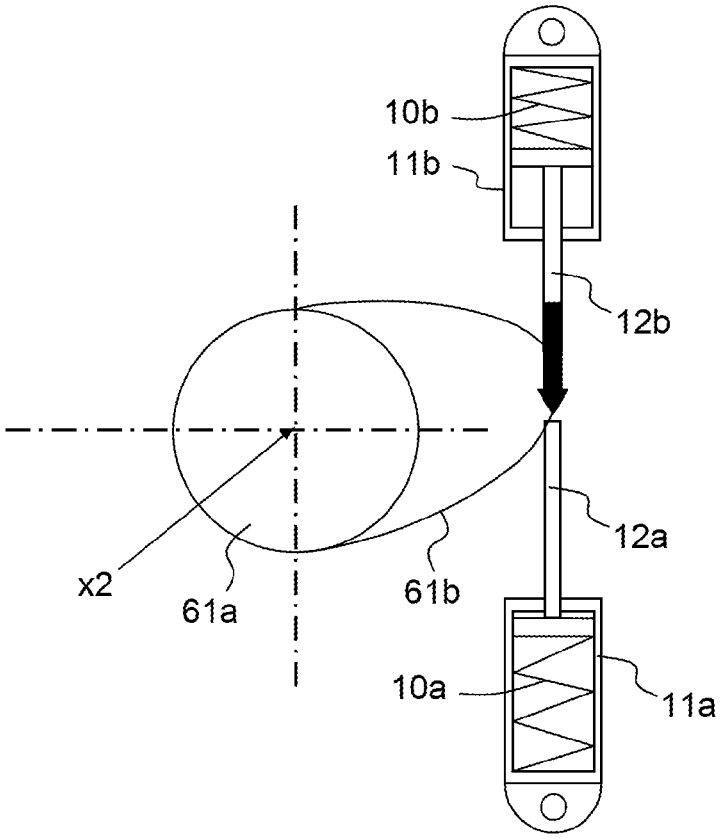

For example, the stabilizing device comprises elastic return means, such as, for example, one or several springs, connecting the rotary part of the tilting structure 6 and the support 5. The elastic return means are arranged in such a way as to return the rotary part 61 of the tilting structure 6 and the support 5 to the deployed relative position. The springs are sized so that they generate a return force that prevents the rotary part 61 from rotating with respect to the support 5 as long as the torque applied on the second axis x2 is below the threshold and allowing the rotary part to rotate with respect to the support 5 about the second axis x2 as soon as the torque exerted on the axis is above the predetermined threshold value. The spring is, for example, a compression spring comprising one end attached to the rotary part 61 and one end secured to the support 5 in terms of rotation about the second axis x2. One embodiment of the pivot connection between the rotary part 61 and the fixed part 62 of the structure 6 is depicted in FIGS. 6 and 7*a*, 7*b*. In this example, the fixed part 63 comprises two female bearings 63*a*, 63*b* of axis x2 spaced apart along the axis x2. The rotary part 61 comprises a pivot pin 61*a* inserted into the female bearings 63*a*, 63*b* so as to be able to pivot with respect to these bearings about the axis x2. The pivot pin 61 is fitted with a yoke 61*b* positioned between the two bearings 63*a*, 63*b*. The yoke is secured to the pivot pin. The stabilizing device comprises two return springs 10*a*, 10*b*, visible in FIGS. 7*a* and 7*b* and arranged symmetrically with respect to a plane of symmetry PP comprising the axis x2 and secured to the fixed part 63. The springs extend longitudinally along an axis perpendicular to the plane PP. Each spring is incorporated into a housing 11*a*, 11*b* secured to the fixed part 63 and presses against the yoke 61*b* via a rod 12*a*, 12*b* extending along the axis perpendicular to the plane PP. The springs are rated to block the rotary part 61 with respect to the fixed part when the structure is deployed and the torque of relative pivoting between the rotary part 61 and the fixed part 63 is below the predetermined threshold and so as to allow movement between these two parts when the torque is above the threshold, as visible in FIG. 7*b*, while applying a return force F that tends to return the rotary part 61 to the deployed position with respect to the fixed part 63. In this case, the rod 12*b* is compressing the spring in the direction of the rotary part and the yoke therefore pivots because of the torque C applied to the rotary part 61 about the axis x2. This type of device is naturally reversible.

Figure 8:
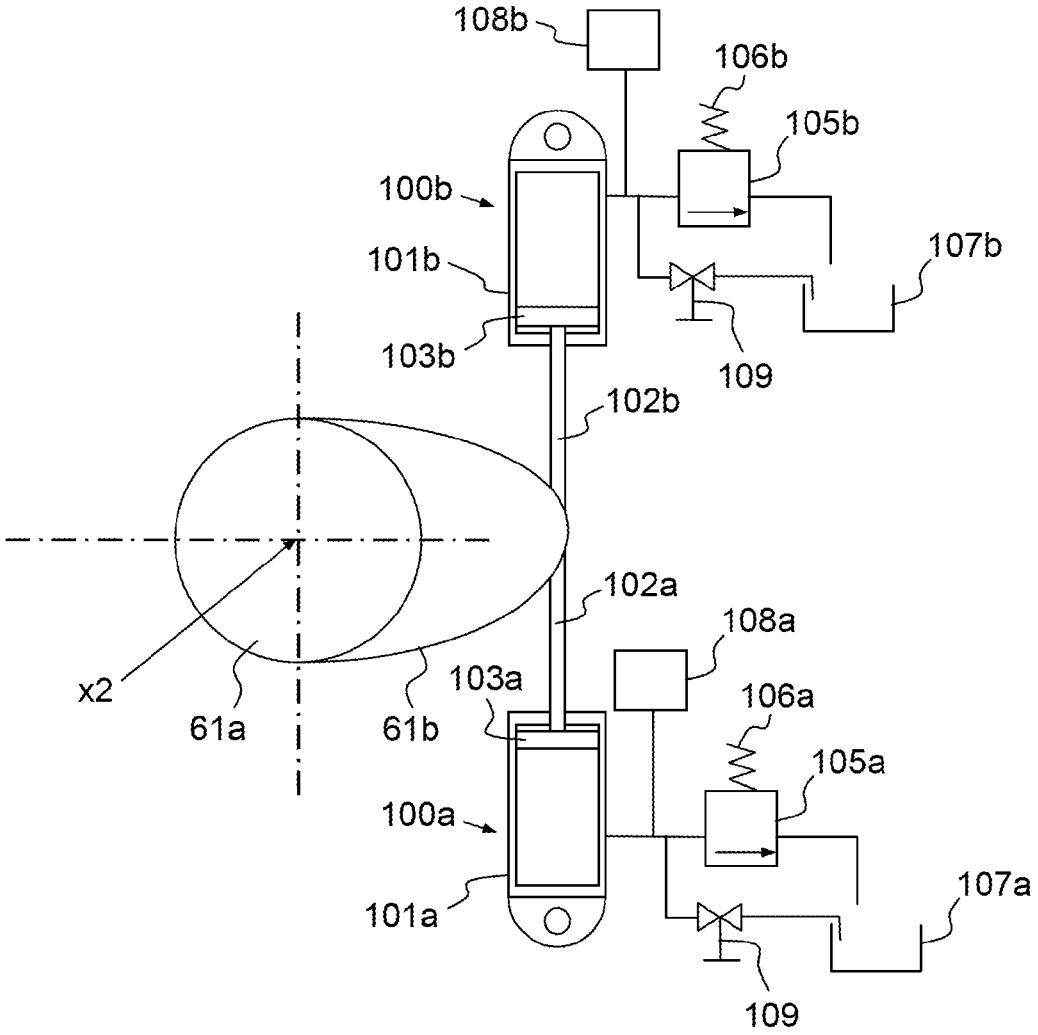
FIG. 8 illustrates an alternative form of stabilizing device.

As an alternative, the stabilizing device is of the type comprising at least one actuating cylinder, the actuating cylinder for example being of the hydraulic or pneumatic or electric type. Each actuating cylinder connects the rotary part of the structure and the support, namely for example the structure and the support 5 or the rotary part 61 of the structure and the fixed part 63. FIG. 8 depicts an example of a stabilizing device of the type comprising two hydraulic actuating cylinders 100*a*, 100*b* which are symmetric with respect to one another about a plane of symmetry PS each comprising a cylindrical housing 101*a*, 101*b* secured to the fixed part 63 and a rod 102*a*, 102*b* pressing against the yoke 61*b* and extending perpendicular to the plane PS, each rod moreover pressing against a piston 103*a*, 103*b* capable of moving inside the housing 101*a*, 101*b* in the direction perpendicular to the plane PS as the yoke pivots with respect to the fixed part 63 about the axis x2. To prevent the rotary part 61 from rotating with respect to the fixed part 63 as long as the torque applied on the second axis x2 is below the threshold and allow the rotary part to rotate with respect to the support 5 about the second axis x2 as soon as the torque applied on the axis is above the predetermined threshold value, use is made for example of pressure limiters 105*a*, 105*b*, loaded by springs 106*a*, 106*b*, set to a value below the threshold torque. When the magnitude of the torque applied on the second axis exceeds the predetermined torque, the pressure in the actuating cylinder increases and the oil contained in the housing escapes through a limiter 105*a*, 105*b* to a reservoir 107*a*, 107*b*. This type of stabilizing device is advantageously reversible. For example, in the case of hydraulic actuating cylinders, the stabilizing device advantageously comprises a pump 108*a*, 108*b* allowing the actuating cylinder to be reset.

Figure 9:
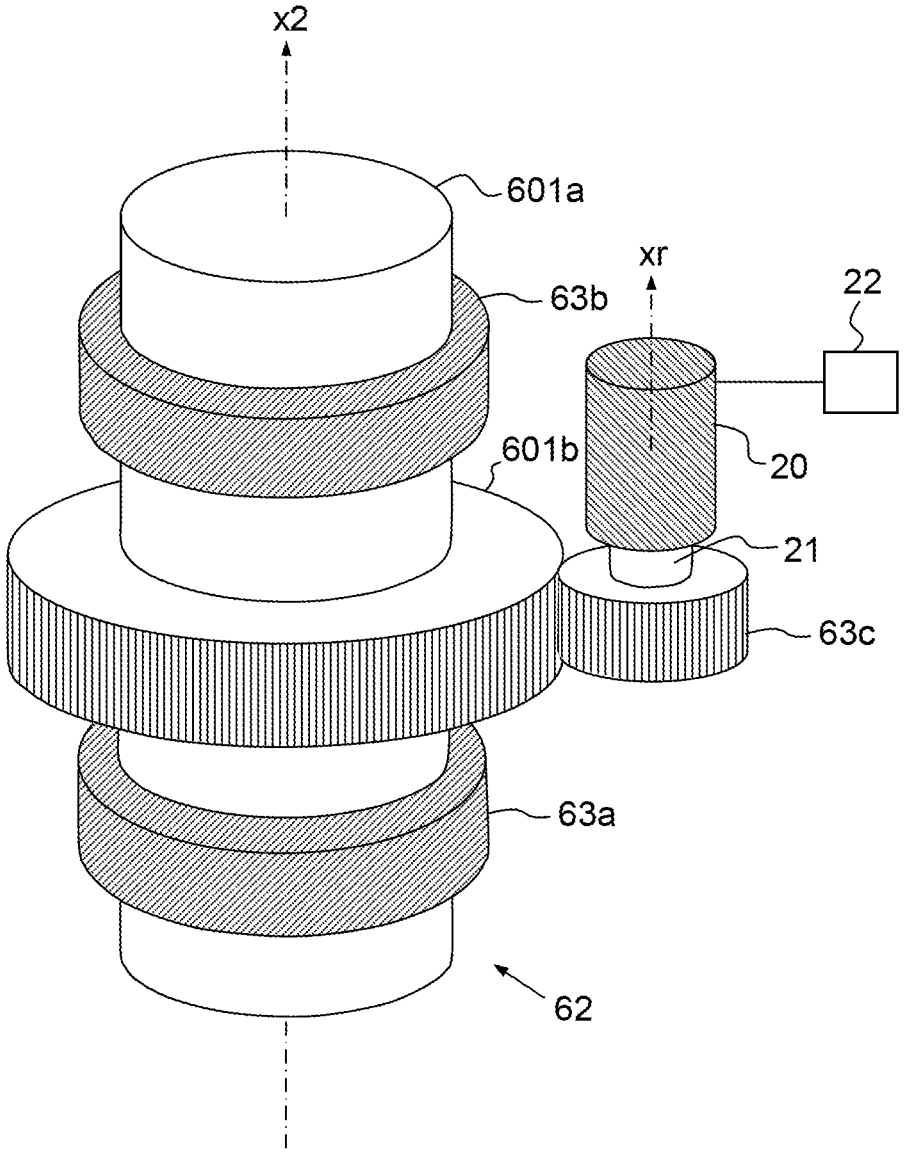
FIG. 9 illustrates another example of a pivot connection about the second axis and of a stabilizing device in which the pivot connection is motorized.

Active stabilizing devices include motorized stabilizing devices. The stabilizing device for example comprises, as depicted in FIG. 9, a motor 20 comprising an output shaft 21 secured to a gearwheel 63*c* of axis xr parallel to the axis x2, secured to the fixed part 63 and meshing with the yoke 601*b* which is a gearwheel of axis x2. The output shaft 21 of the motor 20 is secured to the gearwheel 63*c* in terms of rotation about the axis xr. In motorized stabilizing devices the motor is arranged to cause the rotary part 61 to pivot with respect to the fixed part 63 about the second axis x2 as is the case in the example depicted in FIG. 9. The motor constitutes the actuator of the pivot connection or motorized articulation. The stabilizing device comprises a control device 22 controlling the motor in terms of torque as a function of the pivoting torque applied to the rotary part 61 about the second axis x2 so as to keep the rotary part in the deployed relative position when the torque applied on the second axis is below the threshold torque and so as to allow the rotary part to rotate with respect to the support when the torque applied to the axis exceeds the threshold torque. This type of device is reversible.

In the devices described hereinabove, the stabilizing device allows relative rotation of the rotary part and of the mobile part about the axis x2 in both directions of rotation about the deployed relative position. As an alternative, the stabilizing device is configured to allow relative rotation of the rotary part and of the mobile part about the second axis x2 in just one direction from the relative position. This may be achieved by omitting a spring or an actuating cylinder in the embodiments described hereinabove. This embodiment is easier to achieve from a mechanical standpoint and is less costly in terms of mass and bulk than the embodiment involving rotation in both directions about the axis x2.

Advantageously, the stabilizing device is disengageable. What is meant by a stabilizing device that is disengageable is a stabilizing device comprising a disengagement device that allows the stabilizing device to be disengaged so that it allows the rotary part to rotate with respect to the support even if a torque below the threshold is applied to the second axis. In other words, the stabilizing device switches from an operational configuration in which it prevents the rotary part from rotating with respect to the support about the axis x2 when the torque is below the threshold and in which it allows this rotation when the torque is above the threshold, to a disengaged configuration in which it allows rotation even when the torque applied about the axis x2 is below the threshold. This embodiment makes it possible, outside of operational phases, for the structure to be stowed by pivoting the rotary part of the structure about the second axis in order to bring it from the deployed position relative to the support into a retracted position relative to the support in which position the length of the structure projected on longitudinal axis perpendicular to the first axis and parallel to the support plane is shorter than the length of the structure projected onto an axis when the structure is deployed. In the retracted position, the tilting structure has less bulk in the direction of the longitudinal axis (see figure FIGS. 3 and 4). This embodiment is particularly advantageous in instances in which the tilting structure comprises a rotary part and a fixed part which are joined together by means of the pivot connection about the second axis x2 because, in such a case, the bulk of the tilting structure along an axis perpendicular to the first axis x1 and connecting the first axis x1 and the second axis x2 is reduced when the rotary part leaves the deployed position with respect to the fixed part. The stabilizing device comprises, for example, in the case of a hydraulic actuating cylinder, a valve 109*a*, 109*b* that can be opened or closed and that is interposed between each actuating cylinder 100*a*, 100*b* through which fluid can escape from the actuating cylinder to the reservoir 107*a*, 107*b* when the valve 109*a*, 109*b* is open. The valve is configured to be operated manually or electrically. In the case of a motorized stabilizing device, the control device comprises a disengagement configuration in which it operates the motor in such a way as to deliver zero torque about the axis xr. In the case of a spring-loaded device, the disengagement device advantageously comprises a drive device, not depicted, allowing the housings 11*a* and/or 11*b* of the fixed part 63 to be detached. Advantageously, the stabilizing device comprises means making it possible to lock the position of the rotary part 61 with respect to the fixed part 63 or, more generally, with respect to the support 5, when the structure is in a folded position. Another advantage of the invention is that of allowing a reduction in the bulk of the tilting structure when it is stored on board the ship or when it is handled to be offloaded from the boat, something which may allow the launching system to be passed through a smaller-sized deck hatch.

The handling device may comprise a drive device configured to drive the rotary part in such a way that the tilting structure moves from the deployed relative position into the folded relative position when the torque of relative pivoting exceeds the threshold. This drive device is, for example, the stabilizing device, for example a motorized device as described hereinabove.

As an alternative, the handling device is configured so that when the torque of relative pivoting between the two parts about the axis x2 exceeds the threshold, the rotary part is driven by the cable, in rotation about the second axis with respect to the support. In other words, the torque that drives the rotary part in rotation is the torque of relative pivoting that exceeds the threshold. This torque of relative pivoting is applied via the cable. This device offers the advantage of being reliable and simple. This is for example the case when the pivot connection is free when the torque of relative pivoting exceeds the threshold. In other words, the stabilizing device frees the pivot connection when the torque of relative pivoting exceeds the threshold. When the pivot connection is free, only the friction torque within the pivot connection opposes the rotating of the rotary part when the torque exceeds the threshold. Such is also the case when the stabilizing device is configured to damp the relative rotational movement between the rotary part and the support as described hereinafter. In other words, only the cable applies a torque of relative pivoting between the rotary part and the support about the axis x2 in the direction of relative rotation between the rotary part and the support.

Advantageously, the stabilizing device is configured to damp the relative rotational movement between the rotary part and the support about the second axis of rotation. In other words, the stabilizing device is configured so that the speed at which the jib moves from the deployed position into the folded position is lower than the speed of travel that would be generated by the torque of relative pivoting applied by the cable about the second axis of rotation. The stabilizing device is therefore configured to apply, to the structure, about the axis x2, another torque of relative pivoting between the rotary part and the support. This other torque is applied in the opposite direction to the torque of relative pivoting applied to the rotary part about the axis x2 by the cable and is less than the torque of relative pivoting applied by the cable between the rotary part and the support about the axis x2. The damping makes it possible to avoid excessive amplitudes and speeds of rotational movements of the rotary part of the jib with respect to the support which could cause damage to the device, to the submersible object or injury to the crew. This is, for example, the case of the device described with reference to FIGS. 7*a* to 7*b*. This type of damping is passive and therefore reliable. As an alternative, the damping is active. This may be achieved in the case of a motor by operating the motor in such a way as to oppose the movement of relative rotation between the rotary part and the support about the axis x2 when the rotary part and the support are not in the deployed relative position, namely when the rotation between the rotary part and the support about the axis x2 is permitted.

Examples of pivot connection and of stabilizing devices for the case in which the tilting structure is split into a fixed part and a rotary part have been described. These descriptions also apply to cases in which the rotary part is the structure and the pivot connection about the second axis connects the structure and the support.

Advantageously, the stabilizing device is configured in such a way as to return the rotary part to the deployed position with respect to the support and to keep it in this relative position when, once the stabilizing device allows the rotary part to rotate with respect to the support about the axis x2, the torque of pivoting applied to the rotary part about the axis x2 is below a second threshold torque lower than the first threshold torque. This is achieved automatically in the case of the springs and may be achieved by configuring the control device in the case of a motorized pivot connection and of the reset device in the case of the actuating cylinders. This configuration allows the mission to be resumed under optimal conditions once the event causing the lateral force has disappeared or alternatively allows the structure to be deployed before being stowed on the deck by extending it fully over the deck (not over the sea) in a storage zone, for example, by moving it relative to the support 5 along an axis perpendicular to the axis x1 and parallel to the plane PS if the structure is mounted with translational mobility with respect to the support 5 along an axis xt depicted in FIG. 5 perpendicular to the axis x1. In the operational phase, the structure extends partially over the water. The bulk of the structure parallel to the axis x1 is therefore minimal when the structure is stowed, thereby making it possible to provide a deck hatch with an opening of smaller width for separating the structure storage space from the space in which the structure is placed under operational conditions of launching/recovering and towing the submersible object.

Figure 10:
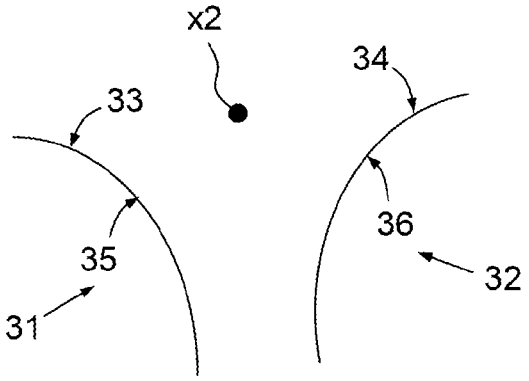
FIG. 10 illustrates the second guide device in section in a plane perpendicular to the second axis x2.

Advantageously, as visible in FIG. 5, the handling device comprises a second cable guide device 30 through which the cable passes between the first guide device 9 and the winch 8 comprising at least one deflector 31, 32 making it possible to prevent the radius of curvature of the cable 2 from dropping below a predetermined threshold in a plane perpendicular to the second axis x2 when the rotary part 61 pivots about the second axis x2 with respect to the support 5. In the embodiment of FIG. 5, the second first guide device 30 comprises two deflectors 31, 32 arranged on each side of the cable 2. They are advantageously symmetric with respect to one another about a plane containing the second axis x2. Each of the deflectors forms a convex bearing surface against which the cable can press when the rotary part 61 pivots about the axis x2. Each deflector 31, 32 has, for example, the shape of a curved plate having a concave surface 35, 36, visible in FIG. 5, and the convex surface 33, 34 parallel to the concave surface visible in FIG. 10. That makes it possible to avoid damage to the cable 2 as the rotary part pivots about the second axis x2. Moreover, that allows the cable 2 to be brought back toward the second axis x2 at the exit from the first guide device, in this case the pulley, between the first guide device and the winch, which in turn has the effect of limiting the variations in length of cable between the winch and the towed body as the rotary part pivots about the second axis x2 and thus limit the up (and down) movements of the towed body that could have the effect of causing the towed body to emerge from the water, thereby limiting the risks of damage to the towed body and the risks of the latter colliding with equipment of the ship or with an operator. Furthermore, that makes it possible, during the operations wherein the tilting structure makes the transition between the recovery or launch position and the position of storage on board the boat, or during the launch or recovery of the towed body, to limit the additional accelerations which further stimulate the movements of the vehicle at the end of the crane cable. That makes the operations of recovering and launching the submersible object easier. A second guide device may also be provided between the pulley and the winch when the rotary part is the tilting structure, when the tilting structure is not secured to the winch in terms of rotation about the second axis x2.

The axis of rotation x2 extends in a plane perpendicular or substantially perpendicular to x1. In the embodiment depicted in FIGS. 3 to 5, the second axis of rotation x2 is substantially perpendicular to the overall plane of the structure in the deployed position. This plane is the plane containing an axis parallel to the axis x1 and the longitudinal axis xs, along which the structure extends longitudinally in the deployed position. As an alternative, for storage space reasons, the axis x2 forms a non-zero angle less than or equal to 30° with the overall plane of the structure. Advantageously, the axis x2 is arranged in such a way that the length of the tilting structure along its longitudinal axis xs is greater when the tilting structure is deployed than when the tilting structure is folded. The longitudinal axis is the axis along which the tilting structure has the greatest length.

In the nonlimiting example of FIG. 3, the first guide device 9 comprises a guide assembly 91 making it possible to prevent the cable 2 from forming an angle smaller than a second predetermined angle in a plane perpendicular to the plane P when the structure is deployed. This guide assembly is arranged downstream of the pulley 90 (namely between the cable end 20 intended to be immersed and the pulley 90). It advantageously comprises two deflectors, not depicted in the figures, arranged on each side of a plane passing through the pulley and perpendicular to the axis of the pulley. Advantageously, the guide device 91 is able to accept the submersible object and has a shape that complements that of the submersible object so as to block the movement of the object in the direction of the winch.

In the present patent application when it is indicated that an element extends longitudinally along an axis that means that it has a shape that is elongate parallel to this axis.

Another subject of the invention is a handling assembly comprising a ship on board which is carried a handling and towing device as claimed in any one of the preceding claims, said support being fixed to the ship in such a way that plane surface 51 forming the plane PS extends substantially parallel to the surface (S) of the water in a calm sea state. Advantageously, the axis x1 is parallel to the axis of the ship. As an alternative, the axis x1 is perpendicular to the axis of the ship.

The invention claimed is:

1. A device for handling and towing a submersible object intended to be installed on a ship, the device comprising:

a support intended to be fixed to the deck of the ship, the support comprising at least one support element comprising a plane surface forming a plane intended to extend parallel to the surface of the water in a calm sea state, a towing cable for towing the submersible object, a winch allowing the cable to be hauled in and paid out, a tilting structure supported by said support, able to pivot with respect to the support about a first axis parallel to said plane, said tilting structure being equipped with a first guide device allowing the cable to be guided, wherein the handling device comprises:

a pivot connection about a second axis situated in a plane substantially perpendicular to the first axis of rotation, arranged so as to allow a rotary part of the tilting structure to rotate with respect to the support, said rotary part being equipped with the first guide device, a stabilizing device able to be in an operational configuration in which it is configured to keep the rotary part of the tilting structure in a deployed position with respect to the support as long as a torque of the relative pivoting between the rotary part and the support about the second axis is below or equal to a predetermined threshold, and so as to allow the rotary part, equipped with the first guide device, to rotate with respect to the support about the second axis once a torque of relative pivoting between the rotary part and the support about the second exceeds said threshold.

2. The handling and towing device as claimed in claim 1, wherein the threshold is above or equal to 50 kN*m.

3. The handling device as claimed in claim 1, wherein the first guide device allows the cable to be guided between the cable end that is intended to be immersed and the winch, and is arranged so as to alter the direction of the cable in a plane perpendicular to the first axis when the tilting structure is in a deployed position with respect to the support, the handling device being arranged in such a way that when the stabilizing device allows the relative rotation between the rotary part and the support about the axis x2, the rotary part is able to move into a folded position, relative to the support, in which position the length of the tilting structure between the first axis of rotation and the first guide device, projected on an axis running parallel to the support plane and perpendicular to the first axis of rotation is of lesser magnitude than when the rotary part and the support are in the deployed relative position.

4. The handling and towing device as claimed in claim 1, wherein the rotary part of the tilting structure is the tilting structure.

5. The handling and towing device as claimed in claim 1, wherein the tilting structure comprises a fixed part secured to the support in terms of rotation about the second axis and the rotary part connected to the support via the part fixed to the support, the fixed part being connected to the rotary part via the pivot connection about the second axis.

6. The handling and towing device as claimed in claim 5, wherein the rotary part extends longitudinally in the continuation of the fixed part along an axis secured to the fixed part perpendicular to the first axis and forming the longitudinal axis of the fixed part.

7. The handling and towing device as claimed in claim 5, wherein the fixed part has the overall shape of a jib the base of which is fixed to the support by means of the pivot connection about the first axis x1 and pointing in a direction xs perpendicular to the first axis, the rotary part extending longitudinally in the continuation of the jib in the direction xs in which the jib points when the structure is deployed.

8. The handling and towing device as claimed in claim 1, wherein the stabilizing device is reversible.

9. The handling and towing device as claimed in claim 1, wherein the stabilizing device is irreversible.

10. The handling and towing device as claimed in claim 1, wherein the stabilizing device is disengageable.

11. The handling and towing device as claimed in claim 10, wherein the stabilizing device comprises locking means allowing the position of the rotary part with respect to the support to be locked when the rotary part is in a folded position with respect to the support.

12. The handling and towing device as claimed in claim 1, wherein the stabilizing device is configured to damp the relative rotational movement between the rotary part and the support about the second axis of rotation.

13. The handling and towing device as claimed in claim 1, wherein the stabilizing device is configured in such a way as to return the rotary part to the deployed position with respect to the support and to keep it in this position when, once the stabilizing device allows the rotary part to rotate with respect to the support about the second axis, the pivoting torque exerted on the rotary part about the axis is below a second threshold torque lower than the first threshold torque.

14. The device as claimed in claim 1, comprising a second guide device allowing the cable to be guided through which the cable passes between the first guide device and the winch, the second guide device comprising at least one deflector making it possible to prevent the radius of curvature of the cable dropping below a predetermined threshold in a plane perpendicular to the second axis when the rotary part pivots about the second axis with respect to the support.

15. The handling and towing device as claimed in claim 1, wherein the second axis of rotation is substantially perpendicular to the plane comprising an axis parallel to the axis and a longitudinal axis along which the structure extends longitudinally when it is in the deployed position with respect to the support.

16. The handling and towing device as claimed in claim 1, wherein the tilting part is configured in such a way that when the torque of relative pivoting exceeds the threshold, the rotary part is driven, by the cable, in rotation about the second axis with respect to the support.

17. The handling and towing device as claimed in claim 1, wherein the winch is fixed in terms of rotation with respect to the support about the axis x2.

18. A handling assembly comprising a ship on board which is carried a handling and towing device as claimed in claim 1, said support being fixed to the ship in such a way that plane surface forming the plane extends substantially parallel to the surface of the water in a calm sea state.

* * * * *